US005579580A

United States Patent [19]

Althaus et al.

[11] Patent Number: 5,579,580

[45] Date of Patent: Dec. 3, 1996

[54] BI-DIRECTIONAL WIRE-WRAPPED BLADE CARTRIDGE

[75] Inventors: Wolfgang Althaus, Milford; Frank Ferraro, Trumbull, both of Conn.

[73] Assignee: Warner-Lambert Company, Morris Plains, N.J.

[21] Appl. No.: 415,105

[22] Filed: Mar. 31, 1995

[51] Int. Cl.[6] ..... B26B 21/02

[52] U.S. Cl. ..... 30/50; 30/78

[58] Field of Search ..... 30/41, 50, 77, 30/81, 83, 87, 78

[56] References Cited

U.S. PATENT DOCUMENTS

| | | | |
|---|---|---|---|
| 1,890,334 | 12/1932 | Muros | 30/50 |
| 5,001,832 | 3/1991 | Althaus | 30/77 |
| 5,090,124 | 2/1992 | Althaus | 30/50 |
| 5,113,585 | 5/1992 | Rogers et al. | 30/41 |
| 5,133,131 | 7/1992 | Hoffman | 30/50 |
| 5,253,420 | 10/1993 | Althaus et al. | 30/50 |
| 5,287,624 | 2/1994 | Mondo et al. | 30/50 X |
| 5,343,622 | 9/1994 | Andrews | 30/50 |

*Primary Examiner*—Hwei-Siu Payer
*Attorney, Agent, or Firm*—Charles W. Almer

[57] ABSTRACT

In order to provide a razor head for arrangement at the front end of a handle, which, with a simple construction and easy assembly suitable for mass production and low manufacturing cost, improves the results of shaving and also can be used at body locations which are difficult to access for cosmetic and medical purposes, a razor head (1) for arrangement at the front end of a handle (2) is proposed, with a housing (3) in which are inserted at least two razor blades (8, 10) at an angle to each other and with essentially parallel cutting edges pointing away from each other, which together with adjacent housing parts define at least one contact plane, to which the respective razor blades are arranged at an essentially optimum cutting angle.

16 Claims, 3 Drawing Sheets

BI-DIRECTIONAL WIRE-WRAPPED BLADE CARTRIDGE

BACKGROUND OF THE INVENTION

The present invention relates to razor blade units, in particular razor blade units for attachment at the front end of razor handles.

Many razor heads for wet razors are known in the art. Generally, razor heads or razor blade units comprise a body which is formed from a plastic housing having a razor blade assembly arranged thereon and is designed to be attached at the front end of a razor handle. In the case of a permanent, rigid connection between the handle and the razor head, i.e, as with an entirely disposable razor unit, the head can consist exclusively of a razor blade assembly. If however the razor head as the razor blade unit can be separated from the handle, as with a disposable cartridge and permanent handle, the razor head includes both plastic housing elements and a razor blade assembly connected thereto. Wet razors of this kind are generally mass-produced articles which are used for daily shaving, cosmetic hair removal, or in the medical field.

Known razor heads usually consist of a plastic housing having a seat and a cap, between which is arranged one or more razor blades with cutting edges pointing in one direction. The cutting edges of the razor blades can be spanned with spaced-apart wires. As the body locations to be shaved are irregular, a number of measures have already been proposed to make guiding of the blades relative to the skin to be shaved flexible. Thus pivot joints arranged in the handle region, razor blades which are inserted in razor blade assemblies for movement in the cutting edge plane, and flexible blades are all known in the art. All the proposed measures are intended to improve the results of shaving by the fact that the cutting edges of the blades can be brought as close as possible to the surface to be shaved. The known systems generally cause relative mobility of the razor blades in relation to the skin to be shaved, but may not ensure that the razor blades actually follow the skin to be shaved, utilize a maximum possible cutting width and retain an optimum possible cutting angle.

Razor heads of this kind which can be guided in more than one direction for shaving purposes are not known in the art. In particular, known razor heads for use in the cosmetic and medical fields for shaving body locations which are difficult to access, for example the bends of the elbows and knees, lead to unsatisfactory shaving results, produce an unpleasant feel of shaving and, in particular, do not position the cutting edges close enough to the surface to be shaved. For this reason the respective locations must be shaved repeatedly one after the other. Further, the conventional razor heads obstruct free guiding of the blades due to forced relative positioning of housing and blade unit elements.

SUMMARY OF THE INVENTION

It is the object of the present invention to provide a razor head for arrangement at the front end of a handle which, while having a simple construction and easy mounting suitable for mass production and low manufacturing cost, improves the results of shaving, can be used in both directions and also at body locations which are difficult to access for cosmetic and medical purposes.

Specifically, in the present invention a razor head is proposed for arrangement at the front end of a handle, with a housing in which are inserted at least two razor blades at an angle to each other and with essentially parallel cutting edges pointing away from each other, which together with the adjacent housing parts define at least one contact plane, to which the respective razor blade is arranged at an essentially optimum cutting angle.

The design of the razor head according to the present invention, which is comprised of a minimum number of components allowing for low cost and easy mounting, allows shaving in two opposite directions, wherein the cutting edges can be applied directly to the skin. Advantageously the blades are inserted in the housing with cutting edges standing free relative to the housing. Further advantageously it is proposed that the razor blades form an angle between each other of less than 180°.

According to the present invention, the razor blades inserted in the housing at their simplest span a contact plane with which the razor head according to the invention is applied to the skin location to be shaved. Due to appropriate shaving movement, the cutting edges which are pointed away from each other are guided over the skin, depending on the direction of advance, and efficient shaving is carried out due to the optimum arrangement of the razor blades with respect to the cutting angle. Further according to the invention, advance movement can be reversed so that shaving can be carried out in both directions, without the cutting angle being dependent upon an inclination of the razor head which must be deliberately adjusted manually by the user.

Advantageously it is proposed that double razor blades arranged in each case with cutting edges pointing away from each other are inserted in the housing. By this measure the results of shaving are further considerably improved. In a preferred embodiment, a clamping strip is placed in the edge region in front of the outer cutting edge of the razor. A clamping strip of this kind, which can be formed for example from rubber, plastic or the like, ensures that the skin is tightened before the cutting edge of the razor blade passes over it. Such a clamping strip, on the one hand, can mask the feel of cutting by the blade passing over the skin and on the other hand, can improve the feel of shaving as a whole. In a further embodiment, rollers can be provided, instead of the clamping strip, with which friction force-reducing aids can be supplied to the skin to be shaved.

Particularly, it is proposed that a number of spaced-apart wires are arranged across the cutting edges. Hence the cutting edges are covered by the wires and so protected by them against cutting the skin during shaving. With a razor head arranged on a handle and designed according to the invention, skin locations to be shaved can be reached easily and directly with the cutting edges, wherein the possibility of cutting the skin is lessened by the wires extending across the cutting edges. Furthermore bidirectional shaving is possible. The razor head makes shaving easier at locations which are difficult to access and considerably improves the results of shaving.

Advantageously it is proposed that the wires are arranged extending across all the cutting edges of the razor blades arranged in the housing. By this measure, manufacture of a razor head according to the invention is considerably simplified by the fact that all the blades can be wound with a wire, a mesh can be laid over all the blades, or individual wire sections can be passed over all the blades. In addition, it is possible to pass coherent strings of pearls made of weld deposit or adhesive over the blades.

In a preferred embodiment, a razor blade assembly is formed from a carrier element, the razor blades and the wires. Manufacture of the razor head is further simplified by this measure in that the razor blade assembly can be manufactured as a separate mounting unit and then inserted in a separately manufactured housing. Advantageously, the surfaces of the carrier element which carry the razor blades are already inclined at the angle at which the cutting edges which are later covered with the wires project at an optimum shaving angle.

In a preferred embodiment when double razor blades are used, there is inserted between them a spacer which in cross-section comprises two arms arranged at the same angle to each other. Advantageously the razor blade assembly comprises a central carrier mounted on the upper razor blades.

In a further preferred embodiment, it is proposed that the razor blades are movable relative to the razor blade assembly. In this case the razor blades can be pivotable in the blade plane or arranged tiltably within narrow ranges. Further it is advantageously proposed that the razor blade assembly is inserted movably in the housing. Due to this measure, the capacity of the razor head to follow contours is further considerably increased. In an embodiment according to this design, it is possible to arrange the razor blade unit oscillatably in the housing to form a so-called vibratory system. This provides the option of using the razor head according to the invention for dry shaving, i.e., without water and shaving cream, as well if the vibrations are fixed accordingly with respect to quantity and direction. A so-called sprung system is of particular advantage, in which the razor blade assembly is arranged movably but with spring loading in the housing. For example this affords the possibility of arranging the razor blades in the cutting edge plane elastically, i.e., so that they are slidable in parallel or rotatable about a vertical axis.

Further, with particular advantage it is proposed that the razor head is arranged movably on the handle. The results of shaving are considerably improved if the razor head is mounted so as to be capable of pivoting relative to the handle about a pivot axis which is located essentially parallel to a cutting edge of the razor blades and essentially in a centre plane between the razor blades. According to such a design, guiding of the blades very close to the surface to be shaved and optimum following of contours is ensured. The same possibilities and advantages arise as with the movable arrangement of the razor blade assembly in the housing.

In a further preferred embodiment, it is proposed that apertures are formed in the razor head, so that wash-out channels are produced, through which foam and hair residues which have accumulated in the region of the razor blades during shaving can be flushed out through the razor head.

Further advantageously it is proposed that the razor head comprises at least one shaving aid. Such a shaving aid can for example be passed through openings formed in the clamping strip into the region of the cutting edges. Also a coating can be formed on the central carrier from a shaving aid, for example polyox. Also the central carrier and/or the clamping strip in turn can be formed from a shaving aid.

The razor head according to the invention allows cheap and easy manufacture and offers very good results of shaving even in body locations which are difficult to access. Furthermore it can be used in two directions for shaving.

Further advantages and characteristics of the invention are apparent from the description below with the aid of the figures.

DETAILED DESCRIPTION OF THE INVENTION

Figure 1:
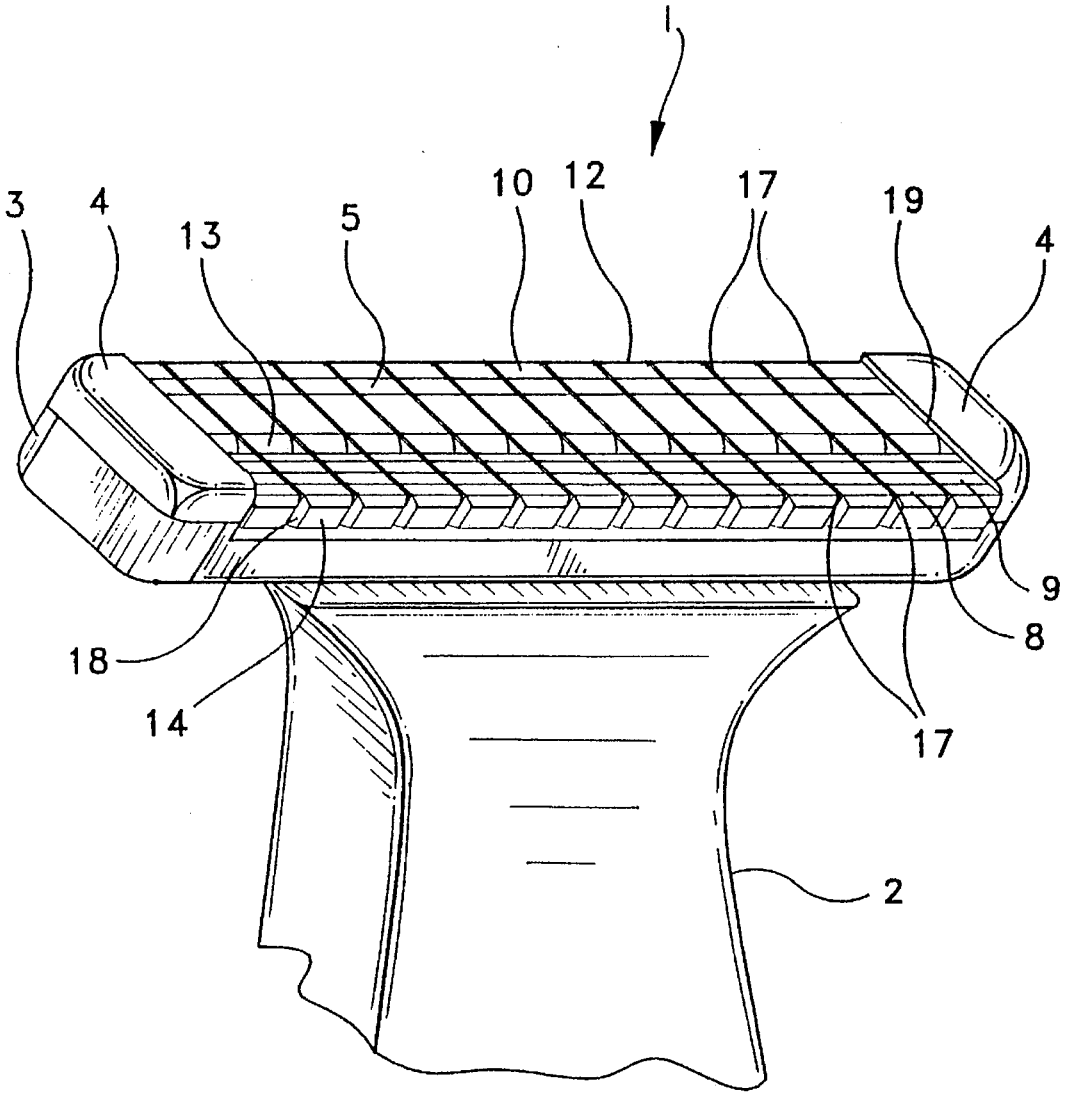
FIG. 1 is a perspective view of one embodiment of a razor head according to the invention.
Figure 2:
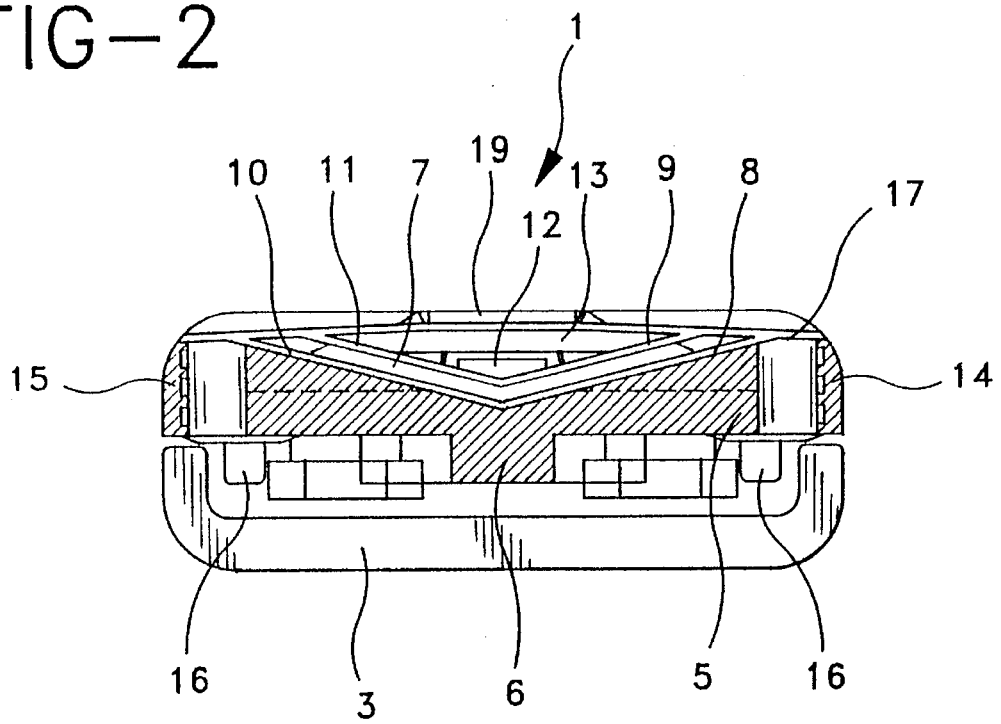
FIG. 2 is a sectional view through the razor head according to FIG. 1.

In the embodiment shown in FIGS. 1 and 2, a razor head 1 is arranged at the upper end of a handle 2. The razor head 1 consists of a housing 3 which is trough-shaped in the embodiment shown and carries an upper cap 4 in the region of each of the narrow side edges. A razor blade assembly 5 consisting of a carrier 6 is inserted in the housing 3. The upper surface of the assembly comprises supporting planes 7 for razor blades. The inclination of the supporting planes 7 is such that the razor blades placed thereon are placed at an optimum cutting angle relative to the prospective contact plane of the housing for optimum shaving due to the arrangement of the razor head on the handle. The optimum angle of a contact plane with the razor blades is preferably less than 180. The razor blades 8 and 10 are placed on the supporting planes of the carrier 7 so that their cutting edges point away from each other. On these two razor blades 8 and 10 is placed a spacer 12 which consists of a central portion and two arms arranged thereon, which are inclined at the same angle to each other as the supporting planes 7. On the two arms of the spacer are placed the razor blades 9 and 11 which are arranged parallel to the respective razor blade 8 or 10 and to each other also with cutting edges pointing away from each other. On them is arranged the central carrier 13. The elements shown can be latched and/or glued or otherwise joined together. Thus the razor blades can be attached to the spacer, for example by gluing, which is in turn together with the central carrier 13 latched or also glued to the carrier 6. Also the parts can be joined together in such a way that the razor blades are at least partially movable. Adjacent to each of the two outer razor blades 8 and 10 is arranged a guide strip 14, 15 which stretches and thus tightens the skin to be shaved during shaving. The inherently free-standing cutting edges of the razor blades 8, 9, 10 and 11, which are arranged at an optimum cutting angle, can then be brought extremely close to the skin to be shaved and thus deliver excellent shaving results.

In the embodiment shown in FIGS. 1 and 2, projections 16 are arranged on the lower side of the carrier, so that wires 17 can be wound over the whole razor blade assembly 5 from one side to the other and around the projections and attached to the projections. For this purpose in the embodiment shown grooves 18 are formed in the guide strip 14, 15 through which the wire is passed. Similarly the wire can be passed through grooves in the central carrier. On the central carrier 13 lastly is placed a cover 18 which can consist of or contain a shaving aid. The wires are preferably arranged at a distance to each other in the range of from about 0.05 mm to about 5.0 mm. and preferably in the range of from about 2.0 mm to about 3.0 mm. The wires have a corresponding thickness in the range of from about 0.05 mm to about 1.0 mm., and preferably about 0.15 mm.

During manufacture, the razor blade assembly 5 is inserted in the trough-shaped housing 3, wherein both fixed and movable insertion are possible, depending on the desired field of application. Finally the caps 4 are connected to the housing 3, so that the razor head 1 is finished. Additional elements such as the guide strip, central carrier and the like are optional; the only essential element is that razor blades with essentially free-standing cutting edges which point away from each other and which are covered by wires are inserted in the housing and can thus be brought as close as possible and in different directions to the skin to be shaved.

Figure 3:
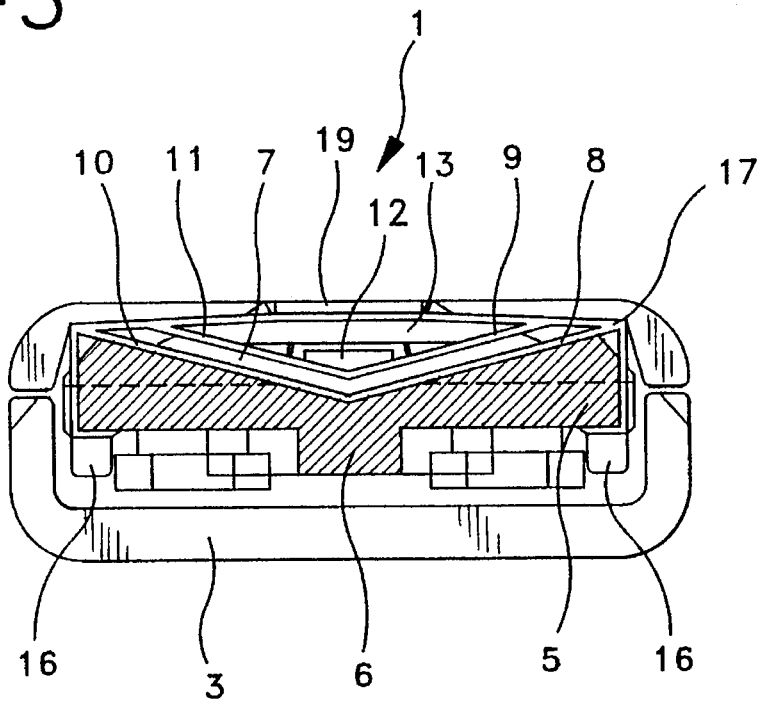
FIG. 3 is a sectional view through a razor head according to a further embodiment of the present invention.
Figure 4:
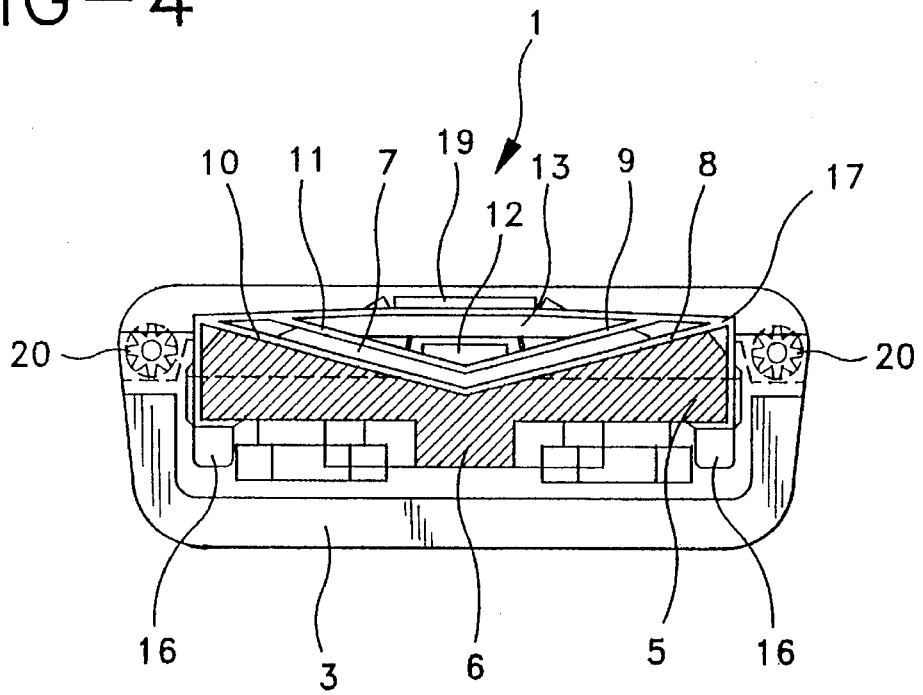
FIG. 4 is a sectional view through a razor head according to a further embodiment of the present invention.

Thus, FIGS. 3 and 4 show further embodiments of the present invention. FIG. 3 illustrates an embodiment which dispenses with any guide strip, so that the cutting edges in free-standing relationship define the contact plane and are guided directly over the skin to be shaved. FIG. 4 illustrates an embodiment in which, instead of a guide strip, there is provided a roller 20, 21 which is advanced in cylinder fashion over the skin to be shaved and can for example serve to apply shaving aids.

Figure 5:
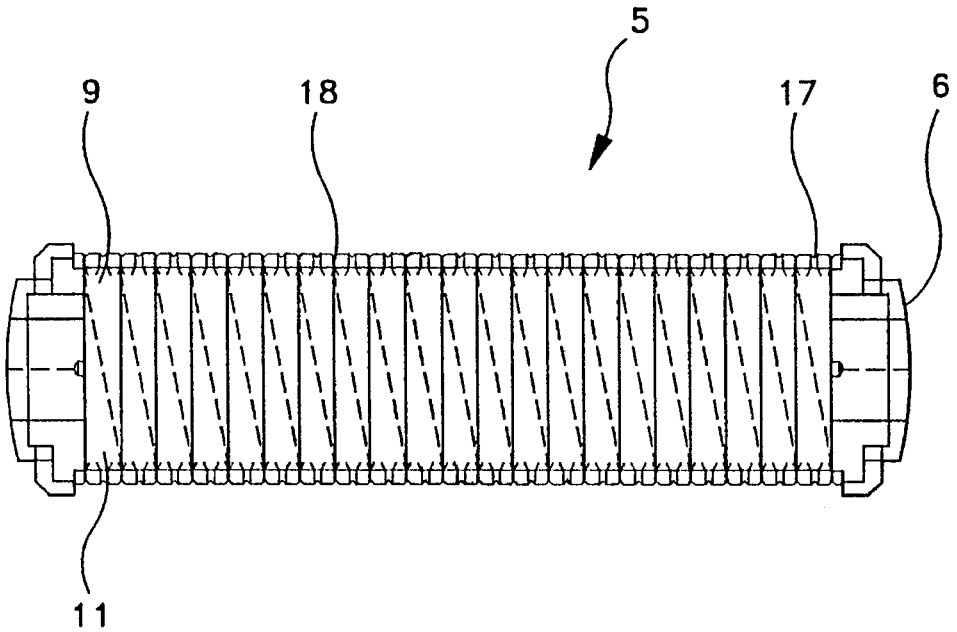
FIG. 5 is a schematic view of a wire winding pattern.

In FIG. 5 a winding pattern is shown by way of example, wherein the wires extend parallel to each other on the upper side of the cutting edges of the razor blades, while they are advanced obliquely on the lower side. This winding method shown has the advantage of easy assembly, as this razor blade assembly has only to be rotated continuously for winding.

While there have been described what are presently believed to be the preferred embodiments of the invention, those skilled in the art will realize that various changes and modifications may be made to the invention without departing from the spirit of the invention, and it is intended to claim all such changes and modifications as fall within the scope of the invention.

We claim:

1. A razor head attached to a razor handle, wherein the razor head comprises a housing in which are inserted at least two razor blades at an angle to each other and with essentially parallel cutting edges pointing away form each other, the housing having at least one part which is adjacent to the razor blades, and wherein the razor blades together with the housing parts adjacent to the razor blades define at least one contact plane to which the respective razor blades are arranged at an essentially optimum cutting angle for shaving which is relative to a main plane of the housing and is less than 180 and wherein a central carrier is placed on the razor blades.

2. The razor head according to claim 1, wherein the razor blades are arranged in the housing with unobstructed free-standing cutting edges.

3. The razor head according claim 2, wherein two sets of upper and lower razor blades with cutting edges pointing away from each other are inserted in the housing.

4. The razor head according to claim 3, wherein a guide strip is arranged on the housing adjacent to the cutting edges.

5. The razor head according to claim 4, wherein the guide strip comprises one or more rollers.

6. The razor head according to claim 3, wherein a plurality of spaced-apart wires are arranged across the cutting edges.

7. The razor head according to claim 6, wherein the wires extend across the cutting edges of all the razor blades.

8. The razor head according to claim 7, wherein the wires are spaced apart from each other at a distance in the range of from about 0.5 mm. to about 5.0 mm.

9. The razor head according to claim 8, wherein the wires have a thickness in the range of from about 0.05 mm. to about 1.0 mm.

10. The razor head according to claim 9, wherein the wires are spaced apart from each other at a distance in the range of from 2.0 to 3.0 mm.

11. The razor head according to claim 10, wherein the wires have a thickness of about 0.15 mm.

12. The razor head according to claim 11, wherein the razor head comprises a razor blade assembly formed from a carrier, the at least two razor blades and the wires.

13. The razor head according to claim 12, wherein the carrier comprises a plurality of supporting planes which are at an angle to each other.

14. The razor head according to claim 13, wherein at least one spacer is arranged between the at least two razor blades.

15. The razor head according to claim 14, wherein the spacer comprises two supporting regions inclined at an angle to each other.

16. The razor head according to claim 2, wherein the razor head comprises at least one shaving aid.

* * * * *